US011040529B2

(12) United States Patent
Sugai

(10) Patent No.: US 11,040,529 B2
(45) **Date of Patent: *Jun. 22, 2021**

(54) LIQUID EJECTING APPARATUS AND LIQUID EJECTING METHOD

(71) Applicant: Seiko Epson Corporation, Tokyo (JP)

(72) Inventor: Keigo Sugai, Chino (JP)

(73) Assignee: Seiko Epson Corporation

( * ) Notice: Subject to any disclaimer, the term of this patent is extended or adjusted under 35 U.S.C. 154(b) by 0 days.

This patent is subject to a terminal disclaimer.

(21) Appl. No.: 16/451,135

(22) Filed: Jun. 25, 2019

(65) Prior Publication Data

US 2019/0389207 A1 Dec. 26, 2019

(30) Foreign Application Priority Data

Jun. 26, 2018 (JP) ..... JP2018-120388

(51) Int. Cl.
*B41J 2/045* (2006.01)
*B41J 2/175* (2006.01)
(Continued)

(52) U.S. Cl.
CPC ..... *B41J 2/04581* (2013.01); *B41J 2/04588* (2013.01); *B41J 2/14274* (2013.01);
(Continued)

(58) Field of Classification Search
CPC ..... B41J 2/04588; B41J 2/04581
See application file for complete search history.

(56) References Cited

U.S. PATENT DOCUMENTS 4,380,018 A 4/1983 Andoh et al.
6,811,133 B2 * 11/2004 Miles ..... B01F 11/0045 251/129.06
(Continued)

FOREIGN PATENT DOCUMENTS

EP 2039516 A1 3/2009
JP 2004-146310 A 5/2004
(Continued)

OTHER PUBLICATIONS

Extended European Search Report for Patent Application No. EP 19182408.5 dated Nov. 12, 2019 (9 pages).

*Primary Examiner* — Shelby L Fidler
(74) *Attorney, Agent, or Firm* — Harness, Dickey & Pierce, P.L.C.

(57) ABSTRACT

A liquid-ejecting-apparatus includes a nozzle that ejects liquid with a viscosity of 50 mPa·s or higher; a pressure-chamber communicating with the nozzle; a pressure-change-portion that changes a pressure of the liquid in the pressure-chamber; and a controller that controls the pressure-change-portion. The controller executes first control of decreasing the pressure of the liquid in the pressure-chamber, hence pulling a center portion of a meniscus toward the pressure-chamber, and forming a liquid-membrane with the liquid at an inner-wall-surface of the nozzle; and second control of, in a state in which the liquid-membrane is formed at the inner-wall-surface of the nozzle, increasing the pressure of the liquid in the pressure-chamber, hence inverting a shape of the center portion of the meniscus to a protruding shape protruding toward an opening of the nozzle and forming a liquid-column, and further, ejecting the liquid-column so as not to contact the liquid membrane.

9 Claims, 9 Drawing Sheets

(51) Int. Cl.
*B41J 2/14* (2006.01)
*B41J 2/18* (2006.01)

(52) U.S. Cl.
CPC ..... *B41J 2/17596* (2013.01); *B41J 2/18* (2013.01); *B41J 2202/11* (2013.01)

(56) References Cited

U.S. PATENT DOCUMENTS

| | | | | |
|---|---|---|---|---|
| 8,622,498 | B2 | 1/2014 | Ozawa | |
| 9,039,115 | B2 | 5/2015 | Zhang | |
| 9,440,781 | B2 | 9/2016 | Ikushima | |
| 2003/0122889 | A1* | 7/2003 | Okuda | B41J 2/04581 347/19 |
| 2007/0046735 | A1* | 3/2007 | Kodama | B41J 2/1433 347/68 |
| 2007/0134434 | A1 | 6/2007 | Yokoyama et al. | |
| 2009/0311116 | A1 | 12/2009 | Bai et al. | |
| 2014/0240399 | A1 | 8/2014 | Saito et al. | |
| 2015/0062255 | A1* | 3/2015 | Sasaki | B41J 2/14233 347/68 |
| 2015/0116402 | A1* | 4/2015 | Zhang | B41J 2/16526 347/10 |
| 2015/0267064 | A1 | 9/2015 | Saito et al. | |
| 2016/0193849 | A1 | 7/2016 | Saito et al. | |
| 2017/0072695 | A1* | 3/2017 | Fukuda | B41J 2/16526 |
| 2019/0389208 | A1 | 12/2019 | Sugai | |
| 2020/0171874 | A1* | 6/2020 | Power | B41F 11/00 |

FOREIGN PATENT DOCUMENTS

| | | | |
|---|---|---|---|
| JP | 2005-340360 | A | 12/2005 |
| JP | 2006-306076 | A | 11/2006 |
| JP | 2007-150051 | A | 6/2007 |
| JP | 2010-110968 | A | 5/2010 |
| JP | 2013-017945 | A | 1/2013 |
| JP | 2014-163021 | A | 9/2014 |
| JP | 2014-188713 | A | 10/2014 |
| JP | 2015-221442 | A | 12/2015 |
| JP | 2020-001196 | A | 1/2020 |

* cited by examiner

LIQUID EJECTING APPARATUS AND LIQUID EJECTING METHOD

The present application is based on, and claims priority from, JP Application Serial Number 2018-120388, filed Jun. 26, 2018, the disclosure of which is hereby incorporated by reference herein in its entirety.

BACKGROUND

1. Technical Field

The present disclosure relates to a liquid ejecting apparatus and a liquid ejecting method.

2. Related Art

Various studies are being made to apply an ink jet technology to, for example, formation of electrodes, direct formation of various electrical components, formation of light emitting bodies and filters used for displays, and formation of microlenses. The increasing range of uses for the ink jet technology increases the variety of types of liquid to be ejected from nozzles. For example, JP-A-2010-110968 discloses a method of ejecting liquid with a high viscosity from a nozzle.

With the liquid ejecting method of JP-A-2010-110968, the range of the viscosity of the liquid within which the liquid can be stably ejected from the nozzle is limited. The inventors of the present application have studied on this point. Consequently, the inventors have determined that a phenomenon in which when the viscosity of the liquid increases, the resistance at the boundary between the inner wall surface of the nozzle and the liquid to be ejected increases and the loss of energy of the liquid required for the ejection due to friction or the like increases leads to poor stability of the ejection. The inventors have found a problem that the poor stability of the ejection becomes more noticeable as the viscosity of the liquid is higher.

SUMMARY

According to an aspect of the present disclosure, a liquid ejecting apparatus is provided. The liquid ejecting apparatus includes a nozzle that ejects liquid with a viscosity of 50 mPa·s or higher; a pressure chamber communicating with the nozzle; a pressure change portion that changes a pressure of the liquid in the pressure chamber; and a controller that controls the pressure change portion. The controller, by driving the pressure change portion, executes first control of decreasing the pressure of the liquid in the pressure chamber, hence pulling a center portion of a meniscus of the liquid in the nozzle toward the pressure chamber, and forming a liquid membrane with the liquid at an inner wall surface of the nozzle; and second control of, in a state in which the liquid membrane is formed at the inner wall surface, increasing the pressure of the liquid in the pressure chamber, hence inverting a shape of the center portion of the meniscus to a protruding shape protruding toward an opening of the nozzle on a side opposite to the pressure chamber and forming a liquid column, and further, ejecting the liquid column from the center portion of the meniscus having the protruding shape toward the opening so as not to contact the liquid membrane.

DESCRIPTION OF EXEMPLARY EMBODIMENTS

A. First Embodiment

Figure 1:
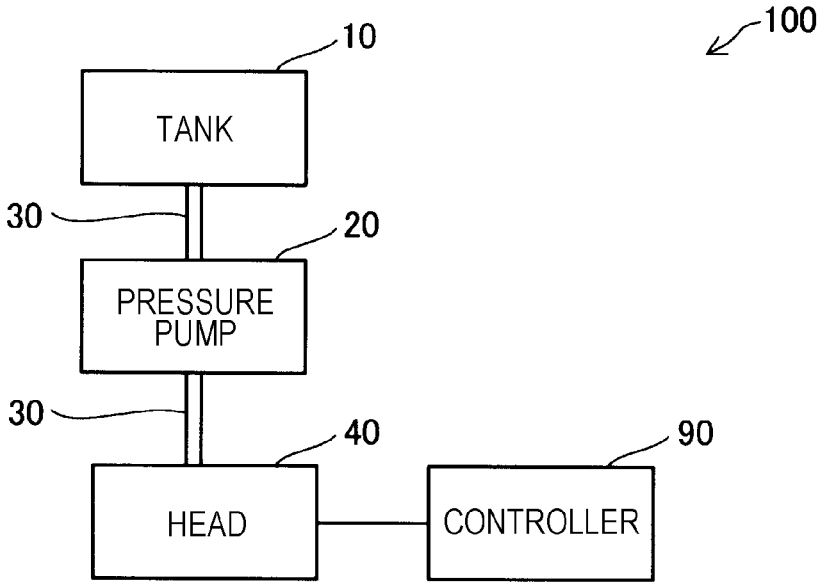
FIG. 1 is an explanatory view illustrating an outline configuration of a liquid ejecting apparatus according to a first embodiment.

FIG. 1 is an explanatory view illustrating an outline configuration of a liquid ejecting apparatus 100 according to a first embodiment. The liquid ejecting apparatus 100 includes a tank 10, a pressure pump 20, a supply pipe 30, a head 40, and a controller 90.

The tank 10 houses liquid. The liquid in the tank 10 is compressed by the pressure pump 20 and is supplied to the head 40 through the supply pipe 30. The pressure pump 20 according to this embodiment is a metering pump capable of supplying liquid at a constant flow rate. As the metering pump, a gear pump with less pulsing may be employed. Alternatively, for example, a buffer tank for absorbing pulsing may be provided at a portion of the supply pipe 30, and one of various metering pumps of diaphragm type and plunger type may be used.

The liquid supplied to the head 40 through the supply pipe 30 is ejected by the head 40. The operation of the head 40 is controlled by the controller 90. The controller 90 can be realized by, for example, a computer including a processor such as a central processing unit (CPU), a main memory, and a non-volatile memory. The non-volatile memory in the controller 90 stores a computer program for controlling the head 40. The controller 90 realizes ejection of the liquid by the head 40, the ejection of the liquid including a first step, a second step, and a third step which will be described later, by executing the computer program.

In this embodiment, the liquid to be ejected by the head 40 has a viscosity of 50 mPa·s or higher. The viscosity of the liquid is desirably within a range of from 50 to 10000 mPa·s. The liquid may be a material in a state in which a substance is in a liquid phase. The liquid includes a material in a liquid state, such as a sol or a gel. The liquid is not limited to liquid as one state of a substance, and includes liquid that particles of a functional material made of a solid substance, such as a pigment or metal particles, are dissolved, dispersed, or mixed in a solvent. A representative example of the liquid may be an ink or a liquid crystal emulsifier. The ink includes various types of liquid-state compositions, such as general water-base ink, oil-base ink, gel ink, and hot-melt ink.

The metal particles may be, for example, a Sn—Pb-based material, a Sn—Ag-based material, a Sn—Ag—Cu-based material, a Sn—Bi-based material, a Sn—Cu-based material, a Sn—Cu—Ni-based material, a Sn—Ag—Bi-based material, a Sn—Ag—Bi—In-based material, a Sn—Ag—Bi—Cu-based material, a Sn—Zn-based material, or a Sn—Zn—Bi-based material.

The solvent may be, for example, straight-chain or branched-chain aliphatic hydrocarbon, alicyclic hydrocarbon, or aromatic hydrocarbon; a halogen substituent of one of these hydrocarbons; or silicone oil, as a desirable example. For example, the solvent may be one or a mixture of at least two of hexane, heptane, octane, isooctane, decane, isodecane, decalin, nonane, dodecane, isododecane, cyclohexane, cyclooctane, cyclodecane, toluene, xylene, mesitylene, Isopar C, Isopar E, Isopar G, Isopar H, Isopar L, Isopar M (Isopar: trade name of Exxon Mobil Corporation), Shellsol 70, Shellsol 71 (Shellsol: trade name of Shell Oil Company), a solvent of Amsco OMS or Amsco 460 (Amsco: trade name of American Mineral Spirits Company), and KF-96L (Shin-Etsu Chemical Co., Ltd.).

The particles are particulate substances each having a desirable shape, such as a spherical shape, a spheroidal shape, or an indefinite shape. The particle diameter is a dimension of a particle obtained based on an assumption that the particle has a spherical shape, and may be represented by a mean particle diameter of particulate materials including particles. The particle-diameter distribution of the particulate materials, which are a set of particles, can be obtained by laser diffracting and scattering method, and for example, can be obtained by Microtrac FRA (manufactured by Nikkiso Co., Ltd.). The mean particle diameter of particles is a volume mean particle diameter obtained by using the particle-diameter distribution of the thus obtained particulate material.

Figure 2:
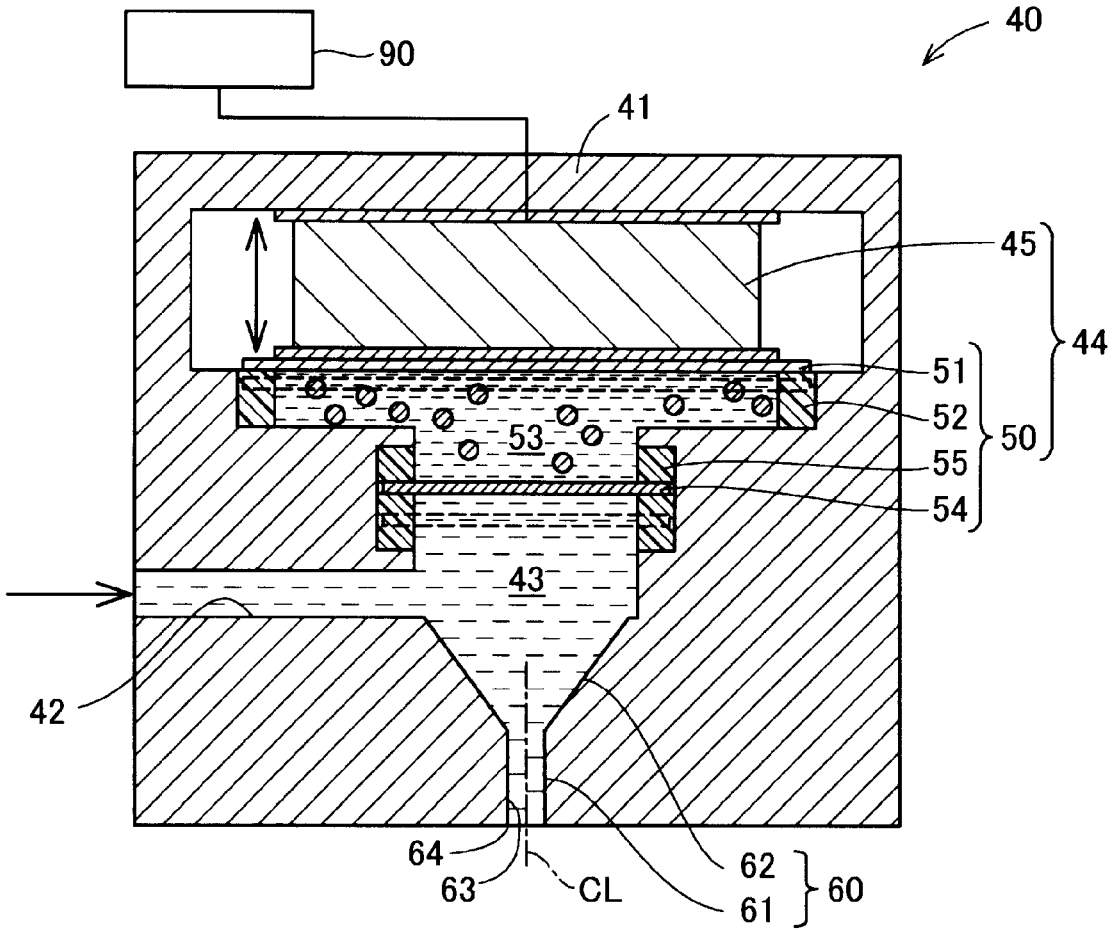
FIG. 2 is an explanatory view illustrating an outline configuration of a head according to the first embodiment.

FIG. 2 is an explanatory view illustrating an outline configuration of the head 40 according to the first embodiment. The head 40 includes a nozzle 60 that ejects liquid, a pressure chamber 43 that communicates with the nozzle 60, and a pressure change portion 44 that changes the pressure of the liquid in the pressure chamber 43. The pressure change portion 44 is controlled by the controller 90.

The liquid supplied from the tank 10 to the head 40 flows to the pressure chamber 43 through a supply channel 42. The liquid in the pressure chamber 43 is compressed by the pressure change portion 44, and hence is ejected from the nozzle 60. In this embodiment, the nozzle 60 includes a straight portion 61 and a tapered portion 62. The straight portion 61 is a portion of the nozzle 60. The straight portion 61 has a nozzle opening 64 at an end portion of the straight portion 61 on the side opposite to the pressure chamber 43, and has an angle of smaller than 5 degrees between a center axis CL of the nozzle 60 and an inner wall surface 63 of the nozzle 60. The inner diameter of the straight portion 61 is set within a range of from 50 to 1000 μm. The angle between the center axis CL of the nozzle 60 and the inner wall surface 63 of the nozzle 60 is calculated in a state in which the surface roughness of the inner wall surface 63 of the nozzle 60 and irregularities due to processing marks in an etching process thereof are averaged. The tapered portion 62 is a portion of the nozzle 60. The tapered portion 62 is provided nearer to the pressure chamber 43 than the straight portion 61, and has an angle of equal to or larger than 5 degrees between the center axis CL of the nozzle 60 and the inner wall surface 63 of the nozzle 60. The inner diameter of the nozzle 60 in the tapered portion 62 increases toward the pressure chamber 43. The angle between the tangential line of the inner wall surface 63 in the tapered portion 62 and the center axis CL of the nozzle 60 is desirably equal to or smaller than 45 degrees. The tapered portion 62 may be straight or curved in a cross section including the center axis CL of the nozzle 60. The nozzle 60 may not include the tapered portion 62. In this case, the straight portion 61 directly communicates with the pressure chamber 43.

The pressure change portion 44 according to this embodiment includes a piezoelectric element 45 and a displacement amplifying mechanism 50. The displacement amplifying mechanism 50 includes a first partition wall 51, a first elastic member 52, a housing chamber 53, a second partition wall 54, and a second elastic member 55. The piezoelectric element 45 expands and contracts in accordance with the voltage to be applied by the controller 90. One end portion in an expansion/contraction direction of the piezoelectric element 45 is fixed to a casing 41 of the head 40. The other end portion in the expansion/contraction direction of the piezoelectric element 45 is fixed to the first partition wall 51. The outer peripheral edge of the first partition wall 51 is supported by the casing 41 via the first elastic member 52. The housing chamber 53 is provided on the side opposite to the piezoelectric element 45 with the first partition wall 51 interposed between the housing chamber 53 and the piezoelectric element 45. A working fluid is sealed in the housing chamber 53. The working fluid according to this embodiment is a liquid containing a filler dispersed therein and having a predetermined viscosity. The second partition wall 54 is provided on the side opposite to the first partition wall 51 of the housing chamber 53. The outer peripheral edge of the second partition wall 54 is supported by the casing 41 via the second elastic member 55. The area by which the first partition wall 51 contacts the working fluid is larger than the area by which the second partition wall 54 contacts the working fluid. The working fluid is not limited to the liquid, and may be a material having fluidity when the working fluid receives a pressure from the outside and is deformed, and exhibits a fluid-like characteristic that can transmit a pressure in all directions like liquid. For example, the working fluid may be one of various types of rubber materials such as silicon rubber, or may be a gel body having both fluidity and elasticity.

When the piezoelectric element 45 is displaced in accordance with the voltage applied by the controller 90, the piezoelectric element 45 displaces the first partition wall 51 toward the housing chamber 53. The first partition wall 51 displaced toward the housing chamber 53 displaces the second partition wall 54 toward the pressure chamber 43 via the working fluid sealed in the housing chamber 53. The second partition wall 54 displaced toward the pressure chamber 43 changes the capacity of the pressure chamber 43. The displacement amount of the second partition wall 54 at this time is larger than the displacement amount of the first partition wall 51 because the displacement amount of the second partition wall 54 is increased according to the Pascal's law. That is, the displacement amount of the second partition wall 54 is larger than the displacement amount of the piezoelectric element 45. Thus, the change in the capacity of the pressure chamber 43 is larger than that of an aspect without the displacement amplifying mechanism 50. When the capacity of the pressure chamber 43 is decreased, the liquid in the pressure chamber 43 is compressed. In contrast, when the capacity of the pressure chamber 43 is increased, the liquid in the pressure chamber 43 is decompressed. The displacement amplifying mechanism 50 is not limited to the above-described aspect, and may employ one of various types of aspects. For example, the capacity of the pressure chamber 43 may be changed by increasing the displacement of the piezoelectric element 45 using a lever, and deforming a vibrating plate that constitutes a wall surface of the pressure chamber 43 using a lever.

Figure 3:
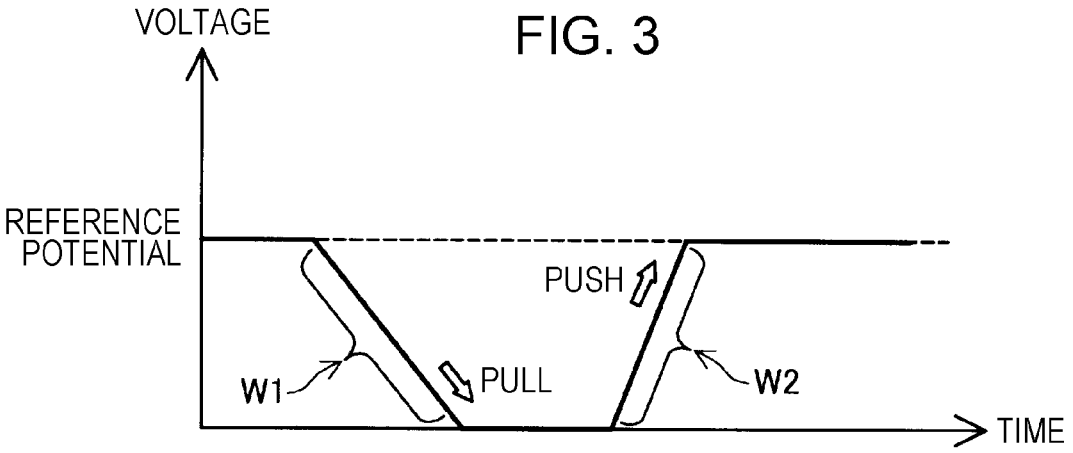
FIG. 3 is an explanatory view illustrating an example of a waveform of a drive voltage to be supplied to a piezoelectric element.

FIG. 3 is an explanatory view illustrating an example of a waveform of a drive voltage to be supplied to the piezoelectric element 45 by the controller 90. FIG. 3 illustrates a drive waveform for performing one cycle of ejecting liquid from the nozzle 60. The drive waveform includes a pull waveform portion W1 for decompressing the liquid in the pressure chamber 43, and a push waveform portion W2 for compressing the liquid in the pressure chamber 43. First, the controller 90 supplies the pull waveform portion W1 to the piezoelectric element 45. When the pull waveform portion W1 is supplied, the piezoelectric element 45 is displaced in the contraction direction, the capacity of the pressure chamber 43 is increased, and the liquid in the pressure chamber 43 is decompressed. Then, the controller 90 supplies the push waveform portion W2 to the piezoelectric element 45. When the push waveform portion W2 is supplied, the piezoelectric element 45 is displaced in the expansion direction, the capacity of the pressure chamber 43 is decreased, the liquid in the pressure chamber 43 is compressed, and the liquid is ejected from the nozzle 60.

Figure 4:
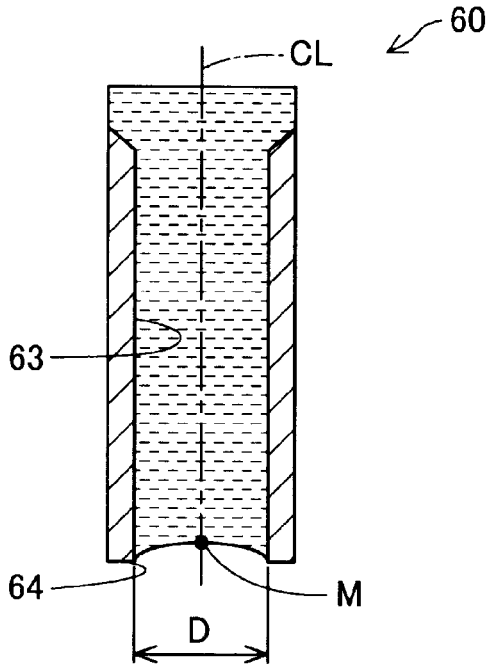
FIG. 4 is an explanatory view schematically illustrating a state of a meniscus in a nozzle in an initial state.

FIGS. 4 through 8 are explanatory views each schematically illustrating a motion of a meniscus in the nozzle 60 when the liquid is ejected from the nozzle 60 according to this embodiment. FIGS. 4 through 8 each illustrate the inside state of the nozzle 60 in the form of a cross section including the center axis CL of the nozzle 60. FIG. 4 illustrates a state of the meniscus in the nozzle 60 in an initial state. In the initial state, the pressure of the liquid in the pressure chamber 43 is not changed. Thus, the outer peripheral edge of the meniscus is located at the nozzle opening 64, and a center portion M of the meniscus is located nearer to the pressure chamber 43 than the nozzle opening 64 in the nozzle 60 due to the surface tension.

Figure 5:
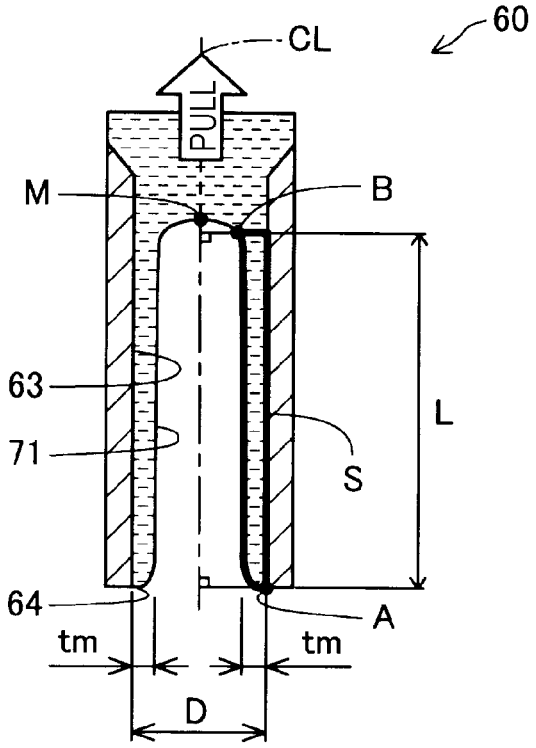
FIG. 5 is an explanatory view schematically illustrating a state of the meniscus in the nozzle in a first step.

FIG. 5 illustrates a state of the meniscus in the nozzle 60 in a first step. First, in the first step, the controller 90 supplies the pull waveform portion W1 to the piezoelectric element 45 to decrease the pressure of the liquid in the pressure chamber 43. Thus, the center portion M of the meniscus is pulled toward the pressure chamber 43 so that a liquid membrane 71 defined by the liquid remains at the inner wall surface 63 of the nozzle 60. In FIG. 5, the center portion M of the meniscus is pulled to the inside of the straight portion 61. Since the liquid membrane 71 is formed at the inner wall surface 63 of the nozzle 60, it can be considered that a quasi-nozzle defined by the liquid membrane 71 is formed in the nozzle 60. In this specification, the quasi-nozzle defined by the liquid membrane 71 is also referred to as pseudo nozzle. A pseudo nozzle diameter Dp is equal to or smaller than a diameter obtained by subtracting a value that is twice a thickness tm of the liquid membrane 71 formed at the inner wall surface 63 of the nozzle 60 from a nozzle diameter D. The pseudo nozzle diameter Dp is a diameter that is equal to or smaller than two-thirds of the nozzle diameter D. The method of calculating the thickness tm of the liquid membrane 71 formed at the inner wall surface 63 of the nozzle 60 is described later. In this specification, the control on the piezoelectric element 45 by the controller 90 to perform the first step is also referred to as first control.

Figure 6:
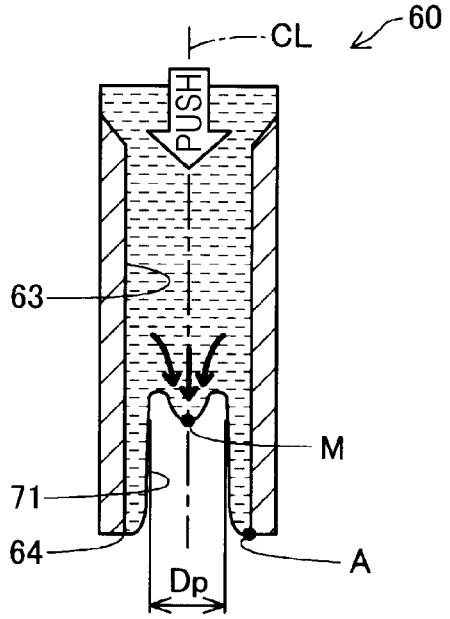
FIG. 6 is an explanatory view schematically illustrating a state of the meniscus in the nozzle in a second step.

FIG. 6 illustrates a state of the meniscus in the nozzle 60 in a second step. In the second step, the controller 90 supplies the push waveform portion W2 to the piezoelectric element 45 in the state in which the liquid membrane 71 is formed at the inner wall surface 63 of the nozzle 60, that is, in the state in which the pseudo nozzle is formed. The piezoelectric element 45 increases the pressure of the liquid in the pressure chamber 43, and hence inverts the shape of the center portion M of the meniscus to a protruding shape protruding toward the nozzle opening 64. The magnitude and speed of the change in pressure, which are required for the inversion and are to be applied to the liquid in the pressure chamber 43, are substantially equivalent to the magnitude and speed of the change in pressure, which are required for ejecting the liquid from the nozzle 60 without formation of the above-described pseudo nozzle. The center portion M of the meniscus has a smaller resistance than the resistance of the liquid that contacts the inner wall surface 63 of the nozzle 60. Thus, when the shape of the center portion M of the meniscus is inverted to the protruding shape protruding toward the nozzle opening 64, the compressed liquid starts concentrating toward the center portion M of the meniscus having the protruding shape.

Figure 7:
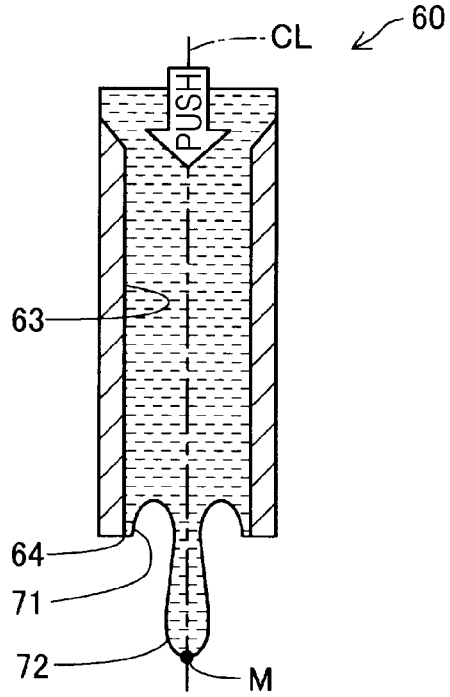
FIG. 7 is an explanatory view schematically illustrating a state of the meniscus in the nozzle in a third step.

FIG. 7 illustrates a state of the meniscus in the nozzle 60 in a third step. In the third step, the controller 90 continues to supply the push waveform portion W2 to the piezoelectric element 45 in the state in which the center portion M of the meniscus has the protruding shape protruding toward the nozzle opening 64. The piezoelectric element 45 increases the pressure of the liquid in the pressure chamber 43, hence a liquid column 72 is formed at the center portion M of the meniscus having the protruding shape toward the nozzle opening 64, and the liquid column 72 is ejected from the nozzle 60 so as not to contact the liquid membrane 71. The center portion M of the meniscus has a smaller resistance than the resistance of the liquid that contacts the inner wall surface 63 of the nozzle 60. Thus, the speed at which the liquid in the liquid membrane 71 formed at the inner wall surface 63 of the nozzle 60 moves toward the nozzle opening 64 is higher than the speed at which the center portion M of the meniscus of the liquid column 72 moves toward the nozzle opening 64. The liquid column 72 is pushed out so as not to contact the liquid membrane 71, and hence, when the liquid column 72 passes through the nozzle opening 64, the diameter of the ejected liquid column 72 in the radial direction of the nozzle 60 becomes smaller than two-thirds of the inner diameter of the nozzle 60. In this specification, the control on the piezoelectric element 45 by the controller 90 to perform the second step and the third step is also referred to as second control.

Figure 8:
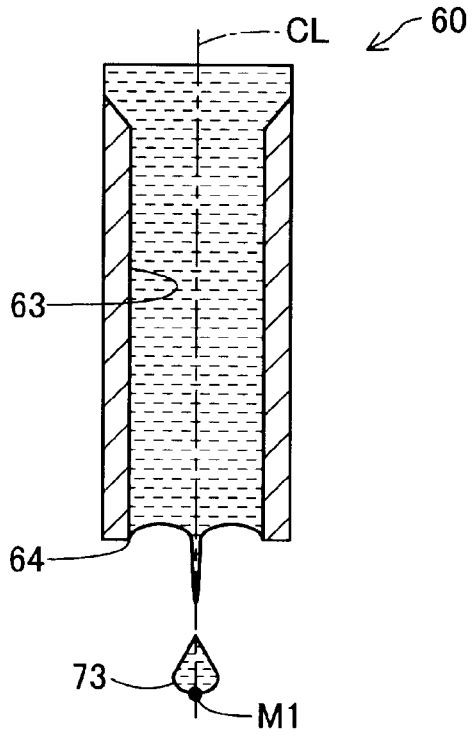
FIG. 8 is an explanatory view schematically illustrating a state of the meniscus in the nozzle after liquid ejection.

FIG. 8 illustrates a state of the meniscus in the nozzle 60 after the third step. After the third step, the liquid column 72 ejected outside the nozzle 60 flies as a liquid droplet 73. Thereafter, the state of the meniscus of the liquid remaining in the nozzle 60 returns to the initial state. In this case, the liquid column 72 may become the liquid droplet 73 in the nozzle 60 and the liquid droplet 73 may be ejected outside the nozzle 60, or the liquid column 72 ejected outside the nozzle 60 may fly as the liquid column 72 without becoming the liquid droplet 73. After the liquid column 72 is ejected from the nozzle 60, the controller 90 may supply the pull waveform portion W1 to the piezoelectric element 45 and decrease the pressure of the liquid in the pressure chamber 43 to cut the tail of the ejected liquid column 72.

In the first step, the speed at which the center portion M of the meniscus moves toward the pressure chamber 43 is desirably about a speed that the liquid membrane 71 is formed at the inner wall surface 63 of the nozzle 60 and a cavity formation phenomenon does not occur in the liquid in the nozzle 60. The cavity formation phenomenon is also referred to as cavitation. In the first step, the speed at which the center portion M of the meniscus is pulled can be set in accordance with the type of the liquid to be ejected, the nozzle diameter D, and so forth. For example, in the third step, the speed at which the center portion M of the meniscus is pulled can be 2 to 100 times lower than the speed at which the liquid to be ejected moves toward the nozzle opening 64.

The speed at which the center portion M of the meniscus moves toward the pressure chamber 43 in the first step is obtained by image capturing the situation in which the center portion M of the pulled meniscus moves by a stroboscope from a lateral side of the nozzle 60 on a predetermined cycle, using a plurality of obtained images, and calculating a mean speed in a period immediately after the center portion M of the meniscus starts moving along the center axis CL of the nozzle 60 to immediately before the center portion M stops moving. The speed at which the liquid to be ejected moves toward the nozzle opening 64 in the third step is obtained by image capturing the situation in which the center portion M of the meniscus of the liquid column 72 or a tip end M1 of the liquid droplet 73 pushed out from the center portion M of the meniscus having the protruding shape moves by a stroboscope from the lateral side of the nozzle 60 on a predetermined cycle, using a plurality of obtained images, and calculating a mean speed in a period immediately after the center portion M of the meniscus of the liquid column 72 or the tip end M1 of the liquid droplet 73 starts moving along the center axis CL of the nozzle 60 to immediately before the center portion M of the meniscus of the liquid column 72 or the tip end M1 of the liquid droplet 73 passes through the nozzle opening 64.

The speed at which the liquid ejected outside the nozzle 60 flies in the third step is obtained by image capturing the situation in which the center portion M of the meniscus of the liquid column 72 or the tip end M1 of the liquid droplet 73 pushed out from the center portion M of the meniscus having the protruding shape moves by a stroboscope from the lateral side of the nozzle 60 on a predetermined cycle, using a plurality of obtained images, and calculating a mean speed in a period immediately after the center portion M of the meniscus of the liquid column 72 or the tip end M1 of the liquid droplet 73 appears outside the nozzle 60 to immediately after the center portion M of the meniscus of the liquid column 72 or the tip end M1 of the liquid droplet 73 has moved by a distance of 0.5 mm from the nozzle opening 64 along the center axis CL of the nozzle 60. However, images obtained after the center portion M of the meniscus of the liquid column 72 or the tip end M1 of the liquid droplet 73 has moved by a distance of 1.0 mm or larger from the nozzle opening 64 along the center axis CL of the nozzle 60 is not used for calculating the mean speed.

As illustrated in FIG. 5, the thickness tm of the liquid membrane 71 formed at the inner wall surface 63 of the nozzle 60 is an average thickness that is obtained by the following method. First, the state of the liquid in the nozzle 60 is image captured by a stroboscope from the lateral side of the nozzle 60, and in an obtained two-dimensional image, a curve portion that satisfies one of conditions (A) to (C) is obtained from the curve expressed by the meniscus. (A) The center of curvature of the meniscus is located on the inner wall surface 63 side of the nozzle 60 with respect to the meniscus. (B) The curvature of the meniscus is infinite. In this case, being infinite represents that the radius of curvature of the meniscus is 100 times or larger that of the nozzle diameter D. (C) The center of curvature of the meniscus is located on the center axis CL side of the nozzle 60 with respect to the meniscus, and the radius of curvature of the meniscus is larger than the maximum radius of the nozzle 60. When the nozzle 60 has the straight portion 61 and the tapered portion 62, the maximum radius of the nozzle 60 is the maximum value of the radius of the tapered portion 62. It is assumed that an end portion of the curve portion thus obtained near the nozzle opening 64 is a point A, and an end portion of the curve portion near the pressure chamber 43 is a point B. Then, an area S is obtained. The area S is a region defined by a perpendicular line of the center axis CL passing through the point A, a perpendicular line of the center axis CL passing through the point B, the inner wall surface 63 of the nozzle 60, and the meniscus. The area S of the region is divided by a distance L between the point A and the point B in the direction along the center axis CL of the nozzle 60. The obtained value is the thickness tm of the liquid membrane 71. In addition, as illustrated in FIG. 6, the minimum diameter of the pseudo nozzle between the center portion M of the meniscus having the protruding shape and the point A in the direction along the center axis CL of the nozzle 60 is the pseudo nozzle diameter Dp.

In the first step, the thickness tm of the liquid membrane 71 formed at the inner wall surface 63 of the nozzle 60 may have any percentage with respect to the nozzle diameter D within a range that the liquid column 72 does not contact the liquid membrane 71 in the second step and the third step. In the first step, the thickness tm of the liquid membrane 71 formed at the inner wall surface 63 of the nozzle 60 is desirably 20% or less with respect to the nozzle diameter D.

The diameter of the ejected liquid column 72 or the ejected liquid droplet 73 in the radial direction of the nozzle 60 when the liquid column 72 or the liquid droplet 73 passes through the nozzle opening 64 can be obtained by image capturing the situation in which the liquid column 72 or the liquid droplet 73 pushed out from the center portion M of the meniscus having the protruding shape by a stroboscope from the lateral side of the nozzle 60 on a predetermined cycle, using a plurality of obtained images, and measuring the maximum diameter of the liquid column 72 or the liquid droplet 73 that passes through the nozzle opening 64.

Figure 9:
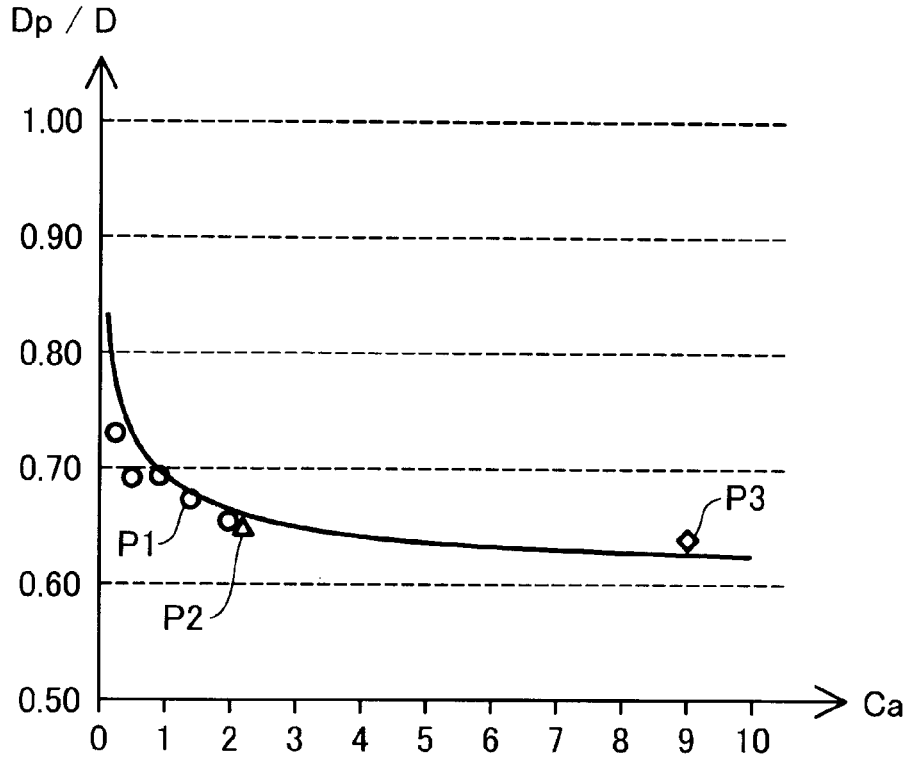
FIG. 9 is an explanatory view illustrating a test result for the relationship between the number of capillaries and the pseudo nozzle diameter.

FIG. 9 is a graph illustrating a test result obtained for the relationship between the number of capillaries Ca and the ratio of the pseudo nozzle diameter Dp to the nozzle diameter D. In this test, the state of the liquid in the nozzle 60 while the above-described first step, second step, and third step were performed was image captured by a stroboscope from the lateral side of the nozzle 60 on a predetermined cycle, and the thickness tm of the liquid membrane 71 was calculated by using obtained images. The diameter obtained by subtracting a value that is twice the calculated thickness tm of the liquid membrane 71 from the nozzle diameter D was assumed as the pseudo nozzle diameter Dp. In this test, a liquid ejecting apparatus 100 including a nozzle 60 made of transparent acrylic resin was used such that the state of the liquid in the nozzle 60 can be image captured by a stroboscope. The test was performed at an ordinary temperature of 25° C. As the liquid, glycerin having a viscosity of 800 mPa·s at the ordinary temperature was used. The number of capillaries Ca was obtained through the following Expression (1) by using a viscosity η of the liquid, a speed V at which the center portion M of the meniscus is pulled, and a surface tension σ of the liquid.

$$Ca=\eta\times V/\sigma \quad (1)$$

In FIG. 9, a point P1 indicated by a circle mark represents a test result when the nozzle diameter D is 160 μm. A point P2 indicated by a triangle mark represents a test result when the nozzle diameter D is 210 μm. A point P3 indicated by a rhombus mark represents a test result when the nozzle diameter D is 310 μm. In addition, FIG. 9 illustrates the relationship between the number of capillaries Ca and the ratio of the pseudo nozzle diameter Dp to the nozzle diameter D in a curve when the thickness tm of the liquid membrane 71 is calculated by using the following Expression (2). In this curve, the diameter obtained by subtracting a value that is twice the thickness tm of the liquid membrane 71 calculated by using the following Expression (2) from the nozzle diameter D was assumed as the pseudo nozzle diameter Dp. The thickness tm of the liquid membrane 71 obtained through the test is substantially based on the following Expression (2).

$$tm=1.34\times Ca^{2/3}/(1+1.34\times 2.5\times Ca^{2/3}) \quad (2)$$

With the test result, the pseudo nozzle diameter Dp decreases as the number of capillaries Ca increases. In a range in which the number of capillaries Ca is two or more, the pseudo nozzle diameter Dp becomes a diameter that is equal to or smaller than two-thirds of the nozzle diameter D while being almost not affected by the size of the nozzle diameter D.

With the liquid ejecting apparatus 100 according to the above-described embodiment, the pseudo nozzle defined by the liquid membrane 71 is formed in the nozzle 60, and the pseudo nozzle ejects liquid. Since the resistance in the pseudo nozzle is smaller than that near the inner wall surface 63 of the nozzle 60, the energy loss of the liquid to be ejected can be decreased, and the diameter of the liquid to be ejected in the radial direction of the nozzle 60 can be smaller than the pseudo nozzle diameter Dp. Accordingly, liquid with a high viscosity and a small diameter can be stably ejected.

In addition, in this embodiment, since the liquid is ejected such that the liquid column 72 is ejected from the pseudo nozzle so as not to contact the liquid membrane 71, the energy loss of the liquid to be ejected can be decreased. Accordingly, the flying speed of the liquid to be ejected can be increased.

In addition, in this embodiment, since the liquid is ejected from the pseudo nozzle defined by the liquid membrane 71, even when liquid including a material with large particle diameters is ejected, clogging of the nozzle 60 can be suppressed.

In addition, in this embodiment, the pseudo nozzle diameter Dp is equal to or smaller than two-thirds of the nozzle diameter D and the liquid is ejected from the pseudo nozzle so as not to contact the liquid membrane 71 that forms the pseudo nozzle. Accordingly, the liquid with a diameter smaller than two-thirds of the nozzle diameter D can be ejected.

In addition, in this embodiment, the speed at which the center portion M of the meniscus moves toward the pressure chamber 43 in the first step is set to be lower than the speed at which the liquid to be ejected moves toward the nozzle opening 64 in the third step. Accordingly, when the center portion M of the meniscus is pulled, occurrence of cavitation in the liquid can be suppressed, and an ejection failure of the liquid from the nozzle 60 can be suppressed.

In addition, in this embodiment, the length by which the center portion M of the meniscus is pulled in the first step is set such that the center portion M is located within the straight portion 61. Accordingly, the change in pressure in the pressure chamber 43 which is required when the center portion M of the meniscus is pulled can be decreased, and the pressure change portion 44 can be decreased in size. In addition, when the center portion M of the meniscus is pulled, mixing of an air bubble into the pressure chamber 43 can be suppressed.

In addition, in this embodiment, since the pressure change portion 44 includes the displacement amplifying mechanism 50, a further large change in pressure can be generated in the liquid in the pressure chamber 43. Accordingly, the center portion M of the meniscus can be largely pulled, and the compressed liquid can be further concentrated at the center portion M of the meniscus having the protruding shape.

B. Other Embodiments (B-1) In the liquid ejecting apparatus 100 of the above-described first embodiment, the pressure change portion 44 includes the displacement amplifying mechanism 50. Alternatively, the pressure change portion 44 may not include the displacement amplifying mechanism 50. In this case, the pressure change portion 44 according to an aspect may include, for example, the piezoelectric element 45 and a vibrating plate that defines a wall surface of the pressure chamber 43. With this aspect, the capacity of the pressure chamber 43 can be changed by expansion and contraction of the piezoelectric element 45 fixed to the vibrating plate. Note that the aspect of compressing the liquid in the pressure chamber 43 is not limited to the above-described piezoelectric system, and may be thermal system of generating air bubbles in the pressure chamber 43 and compressing the liquid, or valve system of compressing the inside of the pressure chamber 43 using a solenoid and a valve and ejecting the liquid.

Figure 10:
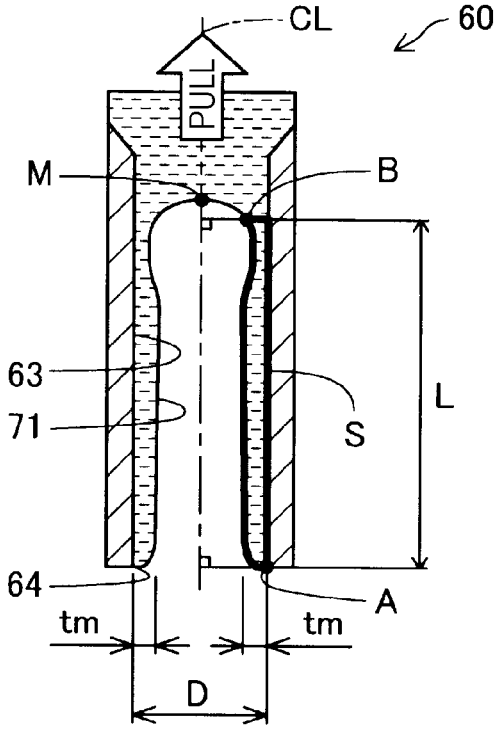
FIG. 10 is another explanatory view schematically illustrating a state of the meniscus in the nozzle in the first step.
Figure 11:
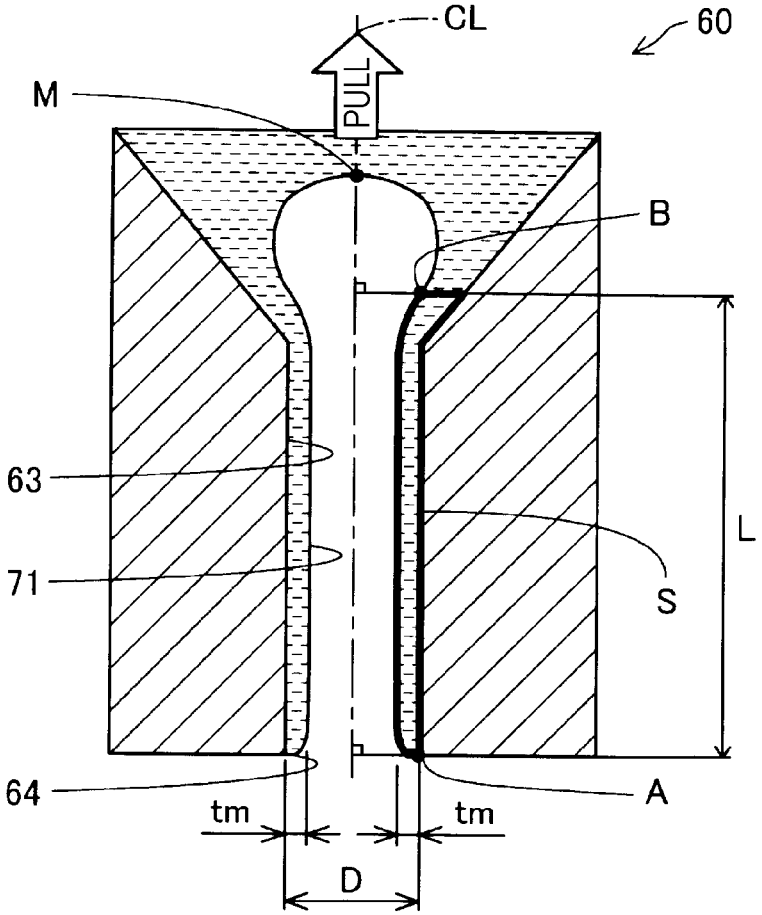
FIG. 11 is still another explanatory view schematically illustrating a state of the meniscus in the nozzle in the first step.

(B-2) In the liquid ejecting apparatus 100 of the above-described first embodiment, as illustrated in FIG. 5, the controller 90 pulls the center portion M of the meniscus into the straight portion 61 such that the thickness of the liquid membrane 71 gradually increases from the point A toward the point B in the first step. Alternatively, as illustrated in FIG. 10, the controller 90 may pull the center portion M of the meniscus into the straight portion 61 such that the liquid membrane 71 near the point B is thinner than the liquid membrane 71 between the point A and the point B in the first step. Still alternatively, as illustrated in FIG. 11, the controller 90 may pull the center portion M of the meniscus into the tapered portion 62 beyond the straight portion 61 in the first step. In this case, the liquid near the tapered portion 62 can be stirred, and hence an increase in the viscosity of the liquid near the tapered portion 62 can be suppressed. In addition, the distance by which the liquid is accelerated by the compression increases from the second step to the third step, and hence the liquid can be ejected at a high speed. The position to which the center portion M of the meniscus is pulled in the first step may be a position at which the second step and the third step can be performed. The inversion of the center portion M of the meniscus in the second step may be performed in the tapered portion 62 or in the straight portion 61 if the center portion M of the meniscus is pulled into the tapered portion 62 in the first step.

(B-3) In the liquid ejecting apparatus 100 of the above-described first embodiment, the liquid to be ejected from the nozzle 60 may contain a filler. Contraction of the volume of the liquid is suppressed in accordance with the type of the filler contained in the liquid, and an advantageous effect of realizing good color reproduction can be obtained. The content of the filler in the liquid may be, for example, 50% by weight or higher.

Figure 12:
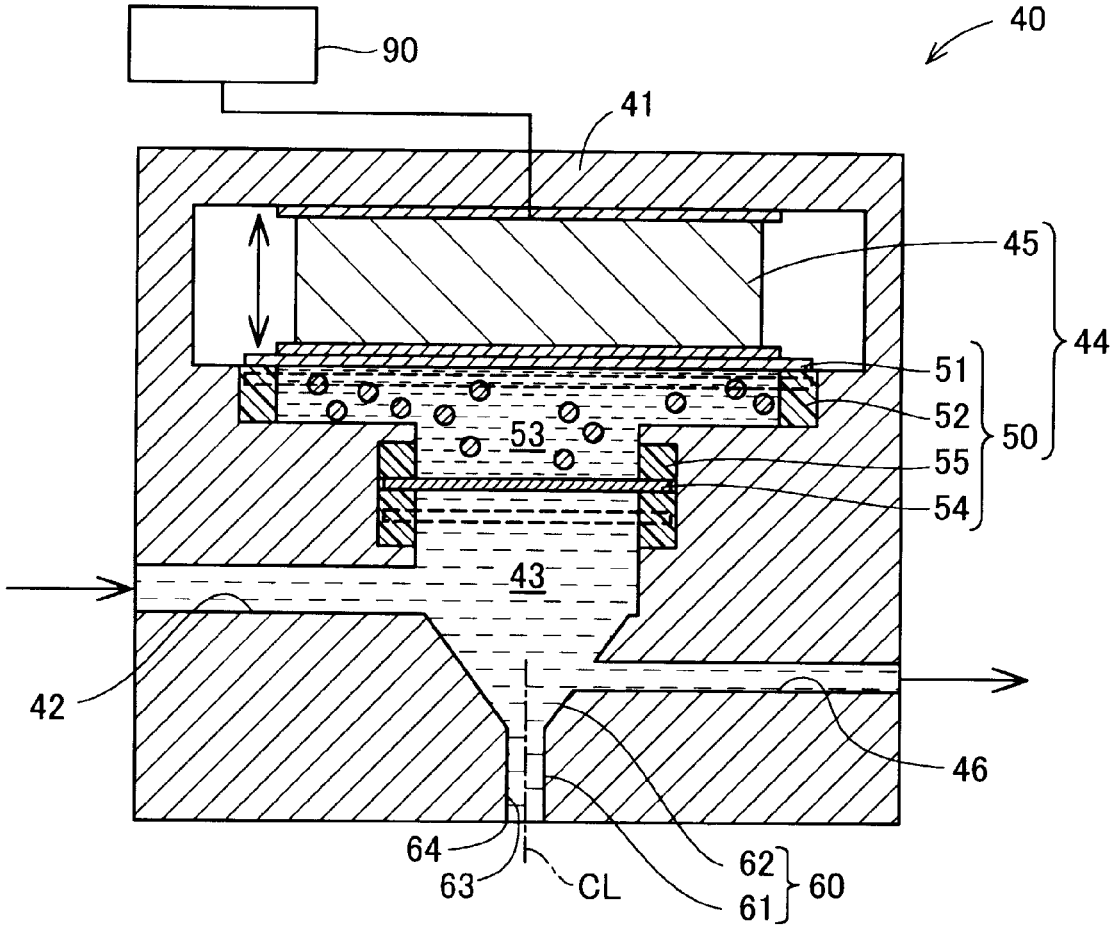
FIG. 12 is an explanatory view illustrating an outline configuration of a head having a circulation channel.

(B-4) As illustrated in FIG. 12, in the liquid ejecting apparatus 100 of the above-described first embodiment, the head 40 may include a circulation channel 46 that communicates with the tapered portion 62 of the nozzle 60. The liquid flowing to the circulation channel 46 without being ejected from the nozzle 60 circulates from the supply channel 42 into the pressure chamber 43 by the pressure of a pump or the like. In this case, a flow of the liquid from the pressure chamber 43 to the circulation channel 46 can be generated, and hence an increase in the viscosity of the liquid can be suppressed from the inside of the pressure chamber 43 to the nozzle 60. The thickness tm of the liquid membrane 71 is measured not on the side provided with the opening of the circulation channel 46, but desirably on the side not provided with the opening of the circulation channel 46. The liquid flowing to the circulation channel 46 may be discharged to a waste liquid tank or the like without circulating into the pressure chamber 43. The circulation channel 46 may communicate with the pressure chamber 43 or the straight portion 61 of the nozzle 60.

Figure 13:
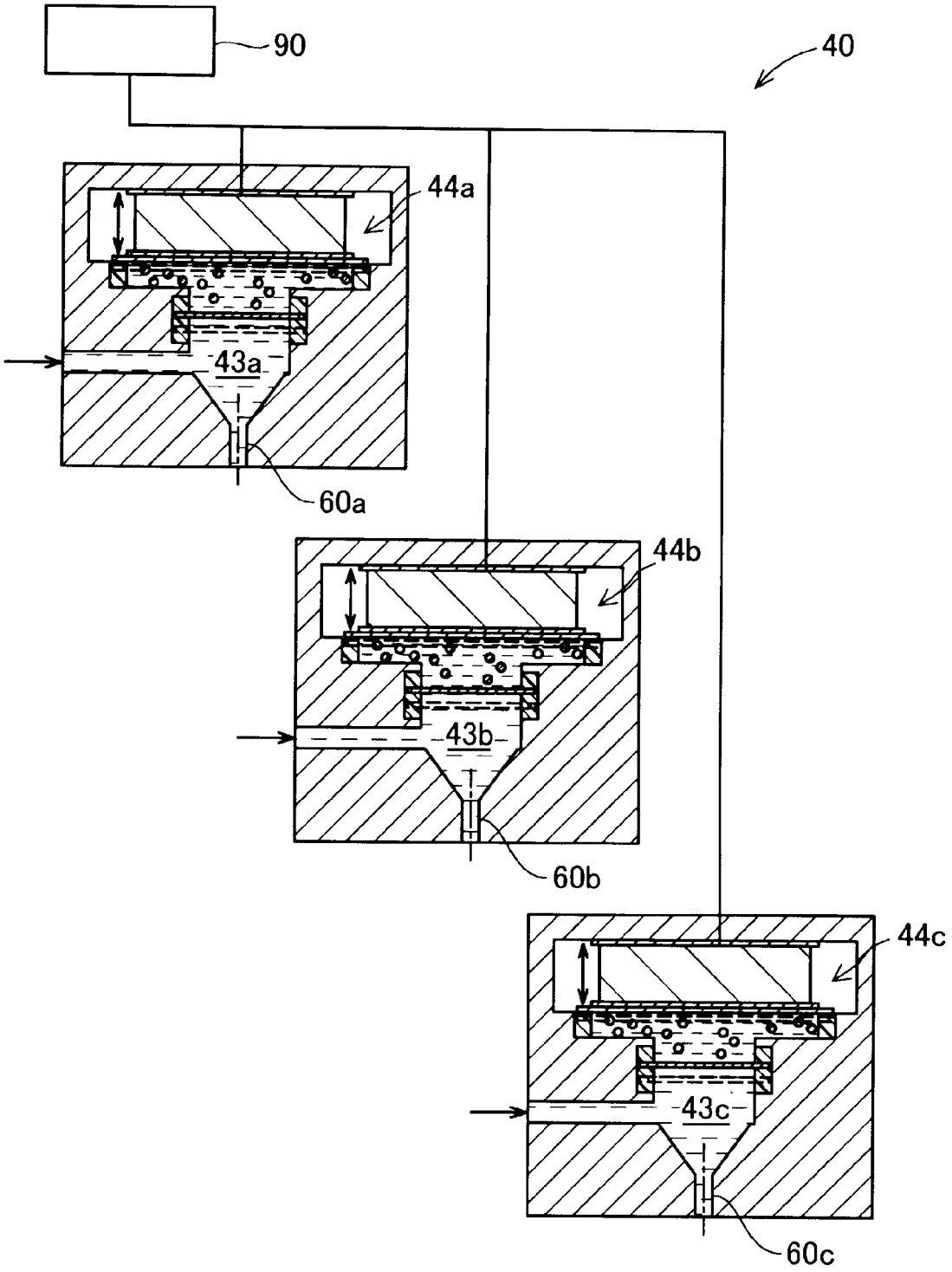
FIG. 13 is an explanatory view illustrating an outline configuration of a head having a plurality of nozzles.

(B-5) In the liquid ejecting apparatus 100 of the above-described first embodiment, the head 40 includes a set of the nozzle 60, the pressure chamber 43, and the pressure change portion 44. Alternatively, as illustrated in FIG. 13, the head 40 may include a plurality of sets of nozzles 60*a*, 60*b*, and 60*c*, pressure chambers 43*a*, 43*b*, and 43*c*, and pressure change portions 44*a*, 44*b*, and 44*c*. In this case, liquid with a high viscosity and a small diameter can be stably ejected from the plurality of nozzles 60*a*, 60*b*, and 60*c*.

(B-6) In the above-described first embodiment, the state of the liquid in the nozzle 60 and outside the nozzle 60 is image captured by a stroboscope from the lateral side of the nozzle 60. However, image capturing may be performed in a direction along the center axis CL of the nozzle 60. In addition, image capturing and measurement may be performed by using, for example, a high-speed camera and a laser displacement gauge.

C. Other Aspects

The present disclosure is not limited to the above-described embodiments, and may be implemented in various aspects within the scope of the disclosure. For example, the present disclosure can be implemented according to the following aspects. The technical features in the above-described embodiments corresponding to the technical features of the aspects described below can be appropriately replaced with one another or combined with one another to address part or the entirety of the problems of the present disclosure or to attain part or the entirety of the advantageous effects of the present disclosure. In addition, a technical feature may be appropriately omitted unless otherwise the technical feature is described as being essential in this specification.

(1) According to an aspect of the present disclosure, a liquid ejecting apparatus is provided. A liquid ejecting apparatus includes a nozzle that ejects liquid with a viscosity of 50 mPa·s or higher; a pressure chamber communicating with the nozzle; a pressure change portion that changes a pressure of the liquid in the pressure chamber; and a controller that controls the pressure change portion. The controller, by driving the pressure change portion, executes first control of decreasing the pressure of the liquid in the pressure chamber, hence pulling a center portion of a meniscus of the liquid in the nozzle toward the pressure chamber, and forming a liquid membrane with the liquid at an inner wall surface of the nozzle; and second control of, in a state in which the liquid membrane is formed at the inner wall surface, increasing the pressure of the liquid in the pressure chamber, hence inverting a shape of the center portion of the meniscus to a protruding shape protruding toward an opening of the nozzle on a side opposite to the pressure chamber and forming a liquid column, and further, ejecting the liquid column from the center portion of the meniscus having the protruding shape toward the opening so as not to contact the liquid membrane.

With the liquid ejecting apparatus according to the aspect, since the resistance on the inner side of the liquid membrane in the nozzle is smaller than that near the inner wall surface of the nozzle, the energy loss of the liquid to be ejected can be decreased, and the diameter of the liquid to be ejected in the radial direction of the nozzle can be smaller than the diameter on the inner side of the liquid membrane. Accordingly, liquid with a high viscosity and a small diameter can be stably ejected.

(2) In the liquid ejecting apparatus according to the aspect, a diameter of the ejected liquid column in a radial direction of the nozzle may be smaller than two-thirds of an inner diameter of the nozzle when the liquid column passes through an end surface of the nozzle near the opening.

With the liquid ejecting apparatus according to the aspect, since the diameter on the inner side of the liquid membrane formed in the nozzle is the diameter that is two-thirds of the inner diameter of the nozzle, the liquid with a diameter smaller than two-thirds of the inner diameter of the nozzle can be ejected.

(3) In the liquid ejecting apparatus according to the aspect, a speed at which the center portion of the meniscus moves toward the pressure chamber in the first control may be lower than a speed at which the liquid column to be ejected moves toward the opening of the nozzle in the second control.

With the liquid ejecting apparatus according to the aspect, when the meniscus is pulled, occurrence of cavitation in the liquid can be suppressed, and an ejection failure of the liquid from the nozzle can be suppressed.

(4) In the liquid ejecting apparatus according to the aspect, the nozzle may have a straight portion and a tapered portion provided nearer to the pressure chamber than the straight portion, a diameter of the nozzle in the tapered portion may increase toward the pressure chamber, and the center portion of the meniscus may be pulled into the straight portion in the first control.

With the liquid ejecting apparatus according to the aspect, the change in pressure in the pressure chamber which is required when the meniscus is pulled can be decreased, and the pressure change portion can be decreased in size. In addition, when the meniscus is pulled, mixing of an air bubble into the pressure chamber can be suppressed.

(5) In the liquid ejecting apparatus according to the aspect, the nozzle may have a straight portion and a tapered portion provided nearer to the pressure chamber than the straight portion, a diameter of the nozzle in the tapered portion may increase toward the pressure chamber, and the center portion of the meniscus may be pulled into the tapered portion in the first control.

With the liquid ejecting apparatus according to the aspect, the liquid near the tapered portion can be stirred, and hence an increase in the viscosity of the liquid near the tapered portion can be suppressed. In addition, the distance by which the liquid is accelerated by the compression increases, and hence the liquid can be ejected at a high speed.

(6) In the liquid ejecting apparatus according to the aspect, the liquid may contain a filler.

With the liquid ejecting apparatus according to the aspect, contraction of the volume of the liquid is suppressed in accordance with the type of the filler contained in the liquid, and an advantageous effect of realizing good color reproduction can be obtained.

(7) The liquid ejecting apparatus according to the aspect may further include a circulation channel that communicates with the pressure chamber and that circulates the liquid to the pressure chamber.

With the liquid ejecting apparatus according to the aspect, a flow of the liquid from the pressure chamber to the circulation channel can be generated, and hence an increase in the viscosity of the liquid can be suppressed from the inside of the pressure chamber to the nozzle.

(8) In the liquid ejecting apparatus according to the aspect, the pressure change portion may include a piezoelectric element and a displacement amplifying mechanism that increases a displacement amount of the piezoelectric element.

With the liquid ejecting apparatus according to the aspect, a further large change in pressure can be generated in the pressure chamber. Accordingly, the center portion of the meniscus can be largely pulled, and the flow of the compressed liquid can be further concentrated at the center portion of the meniscus having the protruding shape.

(9) In the liquid ejecting apparatus according to the aspect, the nozzle, the pressure chamber, and the pressure change portion may form a set and a plurality of the sets may be provided; and the controller may control each of the pressure change portions.

With the liquid ejecting apparatus according to the aspect, liquid with a high viscosity and a small diameter can be stably ejected from the plurality of nozzles.

The present disclosure can be implemented according to various aspects other than the liquid ejecting apparatus. For example, the present disclosure can be implemented according to any aspect of a liquid ejecting method, a liquid ejecting head, a computer program that provides a method of controlling liquid ejection, and a non-transitory storage medium storing the computer program.

What is claimed is:

1. A liquid ejecting apparatus comprising:

a nozzle that ejects liquid with a viscosity of 50 mPa·s or higher;

a pressure chamber communicating with the nozzle;

a pressure change portion that changes a pressure of the liquid in the pressure chamber; and a controller that controls the pressure change portion, wherein the controller, by driving the pressure change portion, executes:

first control of, pulling a center portion of a meniscus of the liquid in the nozzle toward the pressure chamber, and forming a liquid membrane with the liquid at an inner wall surface of the nozzle by decreasing the pressure of the liquid in the pressure chamber, and second control of, in a state in which the liquid membrane is formed at the inner wall surface, inverting a shape of the center portion of the meniscus to a protruding shape protruding toward an opening of the nozzle on a side opposite to the pressure chamber and forming a liquid column, and further, ejecting the liquid column from the center portion of the meniscus having the protruding shape toward the opening so as not to contact the liquid membrane by increasing the pressure of the liquid in the pressure chamber, wherein a speed at which the center portion of the meniscus moves toward the pressure chamber in the first control is lower than a speed at which the liquid column to be ejected moves toward the opening of the nozzle in the second control.

2. The liquid ejecting apparatus according to claim 1, wherein a diameter of the ejected liquid column in a radial direction of the nozzle is smaller than two-thirds of an inner diameter of the nozzle when the liquid column passes through an opening-side end surface of the nozzle.

3. The liquid ejecting apparatus according to claim 1, wherein the nozzle has a straight portion and a tapered portion provided closer to the pressure chamber than is the straight portion, a diameter of the nozzle increases with increasing proximity to the pressure chamber, and the center portion of the meniscus is pulled into the straight portion in the first control.

4. The liquid ejecting apparatus according to claim 1, wherein the nozzle has a straight portion and a tapered portion provided closer to the pressure chamber than is the straight portion, a diameter of the nozzle increases with increasing proximity to the pressure chamber, and the center portion of the meniscus is pulled into the tapered portion in the first control.

5. The liquid ejecting apparatus according to claim 1, wherein the liquid contains a filler.

6. The liquid ejecting apparatus according to claim 1, further comprising:

a circulation channel that communicates with the pressure chamber and that circulates the liquid to the pressure chamber.

7. The liquid ejecting apparatus according to claim 1, wherein the pressure change portion includes a piezoelectric element and a displacement amplifying mechanism that increases a displacement amount of the piezoelectric element.

8. The liquid ejecting apparatus according to claim 1, wherein the nozzle, the pressure chamber, and the pressure change portion form a set and a plurality of the sets are provided, and the controller controls each of the pressure change portions.

9. A liquid ejecting method for ejecting liquid with a viscosity of 50 mPa·s or higher from a nozzle, the method comprising:

a first step of, pulling a center portion of a meniscus of the liquid in the nozzle toward a pressure chamber, and forming a liquid membrane with the liquid at an inner wall surface of the nozzle by a pressure change portion, that changes a pressure of the liquid in the pressure chamber communicating with the nozzle, decreasing the pressure of the liquid in the pressure chamber;

a second step of, in a state in which the liquid membrane is formed at the inner wall surface, inverting a shape of the center portion of the meniscus to a protruding shape protruding toward an opening of the nozzle on a side opposite to the pressure chamber and forming a liquid column by the pressure change portion increasing the pressure of the liquid in the pressure chamber; and a third step of, in a state in which the center portion of the meniscus has the protruding shape protruding toward the opening of the nozzle, ejecting the liquid column from the center portion of the meniscus having the protruding shape toward the opening so as not to contact the liquid membrane by the pressure change portion increasing the pressure of the liquid in the pressure chamber, wherein a speed at which the center portion of the meniscus moves toward the pressure chamber in the first step is lower than a speed at which the liquid column to be ejected moves toward the opening of the nozzle in the second step.

* * * * *